United States Patent [19]

Hait

[11] Patent Number: 4,664,373

[45] Date of Patent: May 12, 1987

[54] DEVICE FOR PERFORMING EXERCISES

[75] Inventor: Paul W. Hait, Santa Clara, Calif.

[73] Assignee: American Innovation, Saratoga, Calif.

[21] Appl. No.: 767,677

[22] Filed: Aug. 22, 1985

Related U.S. Application Data

[63] Continuation of Ser. No. 593,383, Mar. 26, 1984, abandoned.

[51] Int. Cl.[4] ..... A63B 21/06

[52] U.S. Cl. ..... 272/117; 272/123; 272/124

[58] Field of Search ..... 272/93, 116, 117, 122, 272/123, 124, 125–128, 143; 403/104, 372, 370, 374

[56] References Cited

U.S. PATENT DOCUMENTS

| | | | |
|---|---|---|---|
| 588,350 | 8/1897 | Perkins . | |
| 605,747 | 6/1898 | Sachs et al. . | |
| 799,270 | 9/1905 | Roland . | |
| 1,536,048 | 5/1925 | Alastalo | 272/122 |
| 1,552,073 | 9/1925 | Mansfeldt | 272/117 |
| 1,714,391 | 5/1929 | McWhirter | 272/93 |
| 2,470,816 | 5/1949 | Harvey | 272/122 |
| 2,528,213 | 10/1950 | Dantolan . | |
| 3,228,683 | 1/1966 | Leteff | 272/93 |
| 3,637,205 | 1/1972 | Bankston | 272/93 X |
| 3,690,655 | 9/1972 | Chapman . | |
| 3,713,299 | 1/1973 | Duncan | 272/119 X |
| 3,726,522 | 4/1973 | Silberman | 272/123 |
| 3,781,007 | 12/1973 | Baker et al. | 272/123 |
| 3,942,790 | 3/1976 | Rice | 272/93 |
| 4,157,827 | 6/1979 | Winston et al. | 272/117 X |
| 4,218,057 | 8/1980 | Wilson | 272/117 |
| 4,440,391 | 4/1984 | Saenz, Jr. et al. | 272/93 |
| 4,508,466 | 4/1985 | Dennis | 403/104 |

FOREIGN PATENT DOCUMENTS

| | | | |
|---|---|---|---|
| 2529790 | 1/1984 | France | 272/122 |
| 1416911 | 12/1975 | United Kingdom . | |
| 1543678 | 4/1979 | United Kingdom . | |

*Primary Examiner*—Richard J. Apley
*Assistant Examiner*—Robert W. Bahr
*Attorney, Agent, or Firm*—Jack M. Wiseman

[57] ABSTRACT

A device for performing exercises comprising a pole. At one end of the pole is a foot for engaging a support surface. At the opposite end of the pole is a handle to be manually gripped by an operator. Intermediate the ends of the pole is at least one weight releasably locked to the pole for sliding movement along the pole. Midway between the ends of the pole is a cylindrical padded member that is slidable along the pole and is adapted for use in seating the device comfortably on the body of an operator during the performance of certain exercises.

4 Claims, 8 Drawing Figures fig. 1
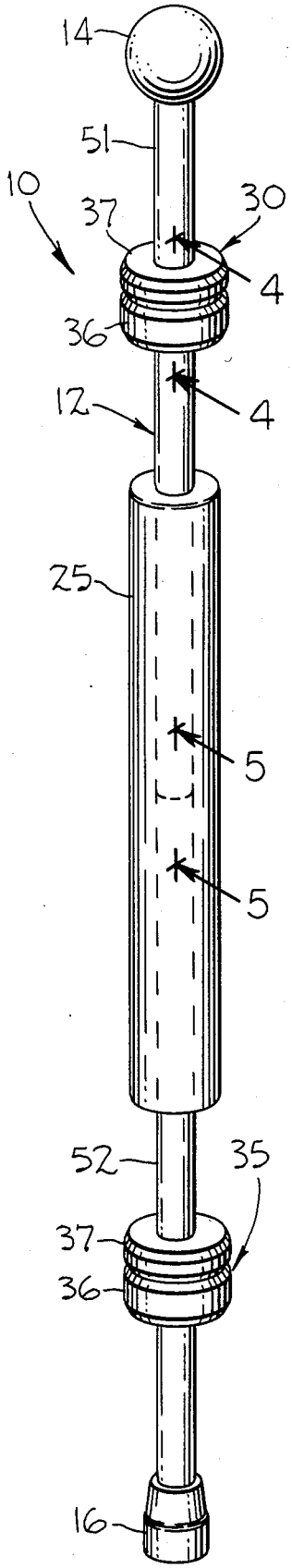
fig. 2
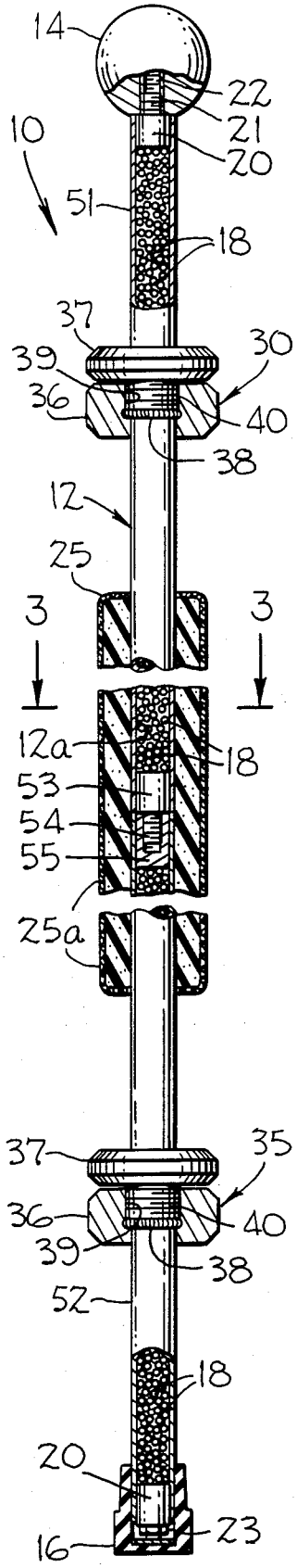
fig 3
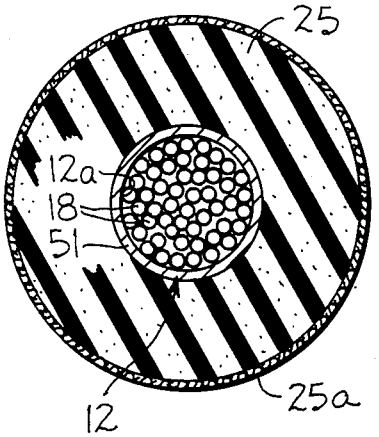
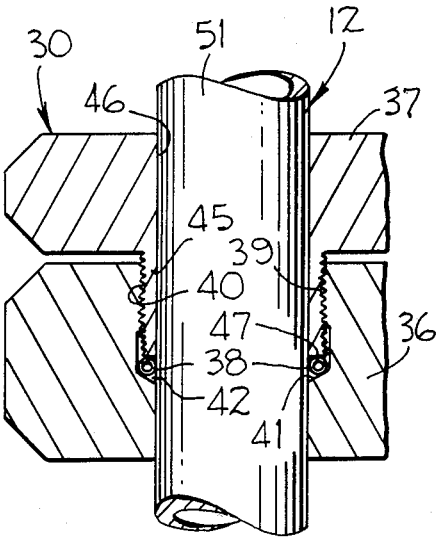
fig. 4
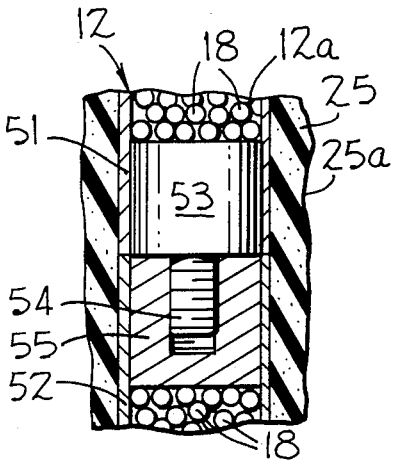
fig. 5

DEVICE FOR PERFORMING EXERCISES

This is a continuation of copending application Ser. No. 593,383 filed on Mar. 26, 1984, now abandoned.

BACKGROUND OF THE INVENTION

The present invention relates in general to devices for performing exercises, and more particularly to a device for performing exercises having a pole with weights adjustably slidable along the pole.

In the patent to Sachs et al., U.S. Pat. No. 605,747, issued on June 14, 1898, for Exercising Apparatus, there is disclosed a device for performing exercises comprising a pole. At the top of the pole is a knob-like handle. At the bottom of the pole is a foot for engaging a foot pad. Weights are detachably fixed to the pole intermediate the ends thereof.

In the patent to Dantolan, U.S. Pat. No. 2,528,213, issued on Oct. 31, 1950, for Bar Bell, there is disclosed an exercising device comprising a rod. Weights slide along the rod.

SUMMARY OF THE INVENTION

A device for performing exercises comprising a pole. At one end of the pole is a foot pad. At the opposite end of the pole is a suitable handle. Intermediate the ends of the pole is at least one weight that is adjustably slidable along the pole. Each weight is releasably secured to the rod by threaded sections rotatable about the axis of the pole.

A feature of the present invention is the support given to an operator by the pole during the performance of the exercises.

Another feature of the present invention is the construction of the handle for the distribution of the force applied by an operator during the performance of exercises.

Another feature of the present invention is the addition of heavy material in an axial opening of the pole for adding weight to the device for performing exercises.

Another feature of the present invention is the employment of a padded sleeve slidable along the pole.

Another feature of the present invention is the sectional disassembling of the device of the present invention for facilitating the carrying thereof in luggage, and for facilitating the shipping, packing and transporting thereof.

DESCRIPTION OF THE DRAWINGS

FIG. 1 is an elevational view of the device of the present invention for performing exercises.

FIG. 2 is an axial sectional view of the device shown in FIG. 1.

FIG. 3 is an enlarged transverse sectional view of the device shown in FIG. 1 taken along line 3—3 of FIG. 2 to illustrate the construction of a pole and a padded sleeve slidable axially along the pole.

FIG. 4 is an enlarged axial sectional view of the device shown in FIG. 1 taken along line 4—4 of FIG. 1 to illustrate an arrangement for releasably retaining a slidable weight in position along the pole.

FIG. 5 is an enlarged transverse sectional view of the device shown in FIG. 1 taken along line 5—5 of FIG. 1 to illustrate a plug for retaining heavy material in the axial opening of the pole.

DETAILED DESCRIPTION OF THE PREFERRED EMBODIMENT

Figure 7:
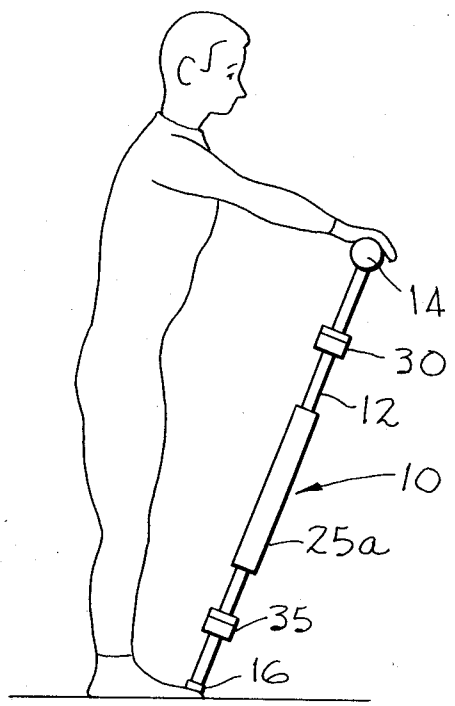
FIG. 7 is a diagrammatic illustration of an operator using the device of the present invention for arm exercises.

Illustrated in FIGS. 1 and 2 is a device for performing exercises. The device 10 comprises a pole 12. The pole 12 is a hollow pole and has an axial opening 12*a* therethrough. In the exemplary embodiment, the pole 12 is a stainless steel tube.

At the top of the pole 12 is fixed a spherical handle or knob 14 (FIG. 2) which is mounted on the pole 12. The knob 14 is in the form of a suitable plastic material, rubber, wood or the like. In the preferred embodiment, the knob 14 is a solid spherical member made of wood. By virtue of the spherical configuration of the knob 14, improved distribution of the force applied by an operator is achieved.

At the bottom of the pole 12 is a suitable plastic or rubber foot 16 for engaging any suitable supporting surface in a yieldable manner. In the exemplary embodiment, the foot 16 is made of rubber and has a flat, closed end at the cylindrical end portion thereof resembling a rubber tip commonly found on the end of a cane or a crutch. The axial opening 12*a* (FIG. 2) contains heavy material 18, such as lead shot, a lead rod, sand or the like. At each end of the pole 12 is a suitable plug 20 (FIGS. 2 and 5). Each plug 20 is made of an expansible rubber material. The rubber plugs 20 seal the tubular pole 12 to retain the heavy material 18 therein. At the top end of the pole 12, the plug 20 has a threaded male member 21, which is received in threaded engagement by a threaded sleeve 22 fixedly secured within the knob 14. At the bottom end of the pole 12, a bushing in threaded engagement with a nut and bolt 23 is inserted into the plug 20.

A padded sleeve 25 (FIGS. 2 and 3) surrounds the pole 12 intermediate the ends thereof. The fit between the padded sleeve 25 and the pole 12 is such that the padded sleeve 25 will remain in a fixed position along the pole 12 until a sufficient force is manually applied thereagainst by an operator to move the padded sleeve 25 along the pole 12 in the axial direction. The sleeve 25 is made of suitable form plastic or rubber material. Encircling the sleeve 25 is a suitable cylindrical fabric cover 25*a*. The padded sleeve 25 is adaptable to rest on portions of the body of an operator during exercises and is padded for the comfort of the operator.

Mounted on the pole 12 for sliding movement therealong are a plurality of weights, such as weights 30 and 35 (FIGS. 1 and 2). Each weight 30 and 35 is releasably locked to the pole 12 and is adjustably slidable along the pole 12 in the axial direction.

Each weight 30 and 35 (FIG. 2) includes a female section 36, a male section 37 and an annular spring 38. The female section 36 has an annular configuration. Formed in the female section 36 is an axial opening 39 surrounded by a threaded wall 40. A shoulder 41 defines one end of the axial opening 39. An annular groove 42 contiguous to the shoulder 41 surrounds the axial opening 39 adjacent the threaded wall 40. An annular groove 42 contiguous to the shoulder 41 and adjacent the threaded wall 40 seats the annular spring 38. The spring 38 is a compression spring and is preferably made of steel.

The male section 37 has an annular configuration and a threaded axial extending projection 45. A central opening 46 extends through the male section 37 including the threaded projection 45. The end of the threaded projection 45 provides a shoulder 47. The annular spring 38 seats in the groove 42 and abuts against the shoulder 41. The pole 12 is received by the axial openings of the female section 36 and the male section 37.

To lock the weight 30 or the weight 35 to the pole 12, the threaded projection 45 of the male section 37 is received by the axial opening 39 in threaded engagement with the wall 40. The male section 37 is rotated until the shoulder 47 of the threaded projection urges the annular spring 38 to decrease its outer diameter to grip the wall of the tube 51 in locking engagement. Now the weight is releasably secured to the pole 12.

For sliding the weight 30 or 35 axially along the pole 12 to a selected location, the male section 37 is rotated about the axis of the pole 12 until the annular spring 38 is relieved of end pressure and increases its outer diameter under its yieldable action for releasing the gripping engagement with the inner wall of the female section 36.

Figure 6:
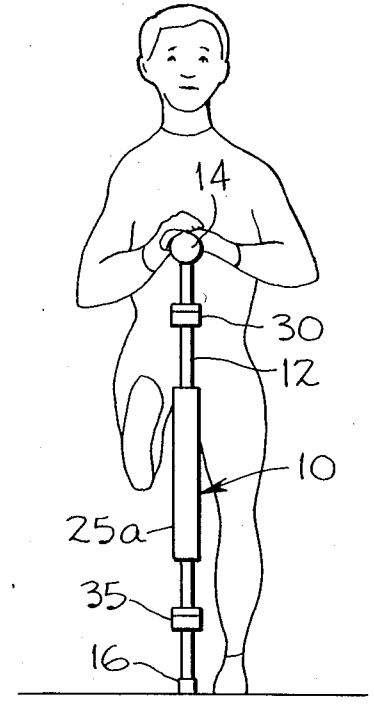
FIG. 6 is a diagrammatic illustration of an operator using the device of the present invention for leg lifting exercises.
Figure 8:
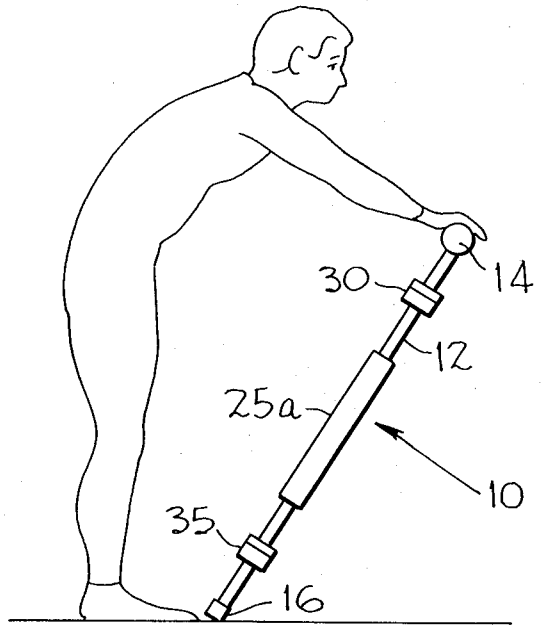
FIG. 8 is a diagrammatic illustration of an operator using the device of the present invention for bending exercises.

In the use of the device 10 (FIGS. 6–8), an operator grips the handle 14 with both hands and places the foot 16 on a supporting surface. During the leg lifting exercises (FIG. 6), the operator lifts the legs alternately while being supported by the pole 12.

For arm exercises (FIG. 7), the operator grips the handle 14 with both hands and places the foot 16 on a suporting surface. While standing substantially erect, the pole 12 is moved at the handle 14 toward and away from the operator by flexing and extending the arms of the operator. The foot 16 pivots about a fixed location on the supporting surface.

For waist bending exercises (FIG. 8), the operator grips the handle 14 with both hands and places the foot 16 on a supporting surface. The operator moves the handle 14 so that the pole 12 moves through various angles relative to the supporting surface by bending the body of the operator at the waist.

By selecting various locations along the pole 12 for the weights 30 and 35, an operator can vary the application of applied force exerted by the operator in performing various exercises.

The pole 12 may be divided into a plurality of end-to-end sections, such as sections 51 and 52. At the juxtaposed ends of the sections 51 and 52 is a suitable plug 53 that retains the heavy material within the section 51. Projection from the plug 53 is a suitable threaded member 54. The threaded member 54 is received in threaded engagement by a cylindrical block 55. The block 55 is seated in the section 52 and retains the heavy material 18 in the section 52. The plug 53 is made of suitable metallic material, such as steel, and the block 55 is made of suitable metallic material, such as steel.

When the sections 51 and 52 are secured together in end-to-end relation by the threaded member 54 and the block 55, the pole 12 forms a unitary structure separable for facilitating the carrying thereof in luggage, and for facilitating the shipping, packing and transporting thereof. To assemble the sections 51 and 52 to form the pole 12, the sections 51 and 52 are aligned axially with the section 51 above the section 52. The threaded member 54 is threaded into the cylindrical block 55 and the sleeve **25*a* is placed around the portion of the pole 12 to surround the juxtaposed ends of the sections 51 and 52**.

I claim:

1. A device for performing exercises comprising:

(a) a tubular pole having a plurality of separable axially aligned sections, said axially aligned sections having confronting ends;

(b) a spherical handle at one end of said pole for manual gripping by an operator;

(c) a foot at the other end of said pole for engaging a supporting surface;

(d) a padded sleeve mounted on said pole for sliding movement therealong in the axial direction of said pole;

(e) heavy material disposed in said separable axially aligned sections;

(f) means at said confronting ends of said separable axially aligned sections for detachably securing said separable axially aligned sections at the confronting ends thereof and for providing separable plugs to retain said heavy material in said separable axially aligned sections;

(g) a plug disposed within said pole at each end thereof to retain said heavy material in said pole;

(h) at least one weight having an opening therethrough to receive said pole for sliding movement along said pole in the axial direction of said pole, said weight comprising threaded sections disposed in mating threaded engagement about said pole for releasably locking said weight to said pole for holding said weight in a fixed axial position along said pole, said threaded sections being rotatable about the axis of said pole to releasably lock said weight to said pole, said weight comprising an annular spring engageable by said threaded sections to control the locking engagement between said weight and said pole.

2. A device as claimed in claim 1 wherein said spherical handle is attached to said plug disposed at said one end of said pole.

3. A device as claimed in claim 1 wherein said annular spring is concentrically disposed about said pole and through which said pole passes, and one of said threaded sections being rotatable about the axis of said pole to urge said annular spring to decrease its diameter for gripping said pole in locking engagement.

4. A device as claimed in claim 3 wherein another of said threaded sections is formed with an annular tapered shoulder and an annular groove adjacent said annular shoulder through which said pole passes, said annular spring being seated in said groove adjacent said annular tapered shoulder, said one threaded section being formed with an annular shoulder through which said pole passes, said one threaded section is rotated until the shoulder thereof urges said annular spring to advance along said annular tapered shoulder to decrease its diameter for gripping said pole in locking engagement.

* * * * *